US005947110A

United States Patent [19]

Malo et al.

[11] Patent Number: 5,947,110

[45] Date of Patent: Sep. 7, 1999

[54] FLUE GAS FLOW CONTROL

[75] Inventors: Mark R. Malo, Middletown; Raymond W. Cournoyer; James M. Niziolek, both of Enfield, all of Conn.

[73] Assignee: Combustion Engineering, Inc., Windsor, Conn.

[21] Appl. No.: 08/738,083

[22] Filed: Oct. 25, 1996

[51] Int. Cl.[6] ..... F23J 11/00

[52] U.S. Cl. ..... 126/312; 126/307 R; 126/85 B; 126/80

[58] Field of Search ..... 126/312, 85 B, 126/500, 533, 534–536, 80, 307 R; 237/12.3 C

[56] References Cited

U.S. PATENT DOCUMENTS 2,619,022 11/1952 Hergenrother .
3,111,122 11/1963 Ware et al. ..... 126/85 R
5,046,663 9/1991 Bittmann ..... 126/110 B
5,669,555 9/1997 Mosig ..... 126/85 B

FOREIGN PATENT DOCUMENTS 6-193858 7/1994 Japan .

*Primary Examiner*—Larry Jones
*Attorney, Agent, or Firm*—Alix, Yale & Ristas, LLP

[57] ABSTRACT

The pressure pulsations caused by the flow patterns of flue gases entering a flue gas stack from a horizontal duct are eliminated or reduced by the installation of a partition plate in the stack opposite the inlet duct. This negates the adverse interaction of the two vortices in the stack formed by the entering flue gases and allows the vortices to travel independently up the stack.

6 Claims, 3 Drawing Sheets

FLUE GAS FLOW CONTROL

BACKGROUND OF THE INVENTION

The present invention relates to means for controlling the flue gas flow pattern created by the flow of the flue gas from a horizontal duct into a vertical flue gas stack, thereby eliminating or significantly reducing any adverse effects resulting from that pattern.

The flow patterns in circular flue gas stacks formed by the flow of the flue gas from a horizontal duct into stack can best be characterized by two counter-rotating vortices issuing from the side walls of the duct, often referred to as a breech, into the stack. These vortices are unstable and interact with each other as the flue gas travels up the stack. The swirling flow in the stack is controlled by one of the two counter-rotating vortices. Flow instabilities result in a momentary change in direction of the swirl as the opposing vortex gains control. This in turn results in pressure pulsations which travel back through the plant equipment. This can have an adverse effect on the operation and structural integrity of the process and equipment.

As one example, gas turbines are often used to provide electric power usually for standby or peaking power. Because the thermal efficiency of gas turbines alone is rather low due to the high exit gas temperature, the gas turbine is most often combined with a heat recovery steam generator and a steam turbine to produce additional electricity. As a combination of a gas turbine cycle and a steam turbine cycle, these systems are referred to as "combined cycles". Gas turbines with heat recovery steam generators are also used to produce process steam in co-generation plants.

In the situation of combined cycles or co-generation, the pressure pulsations previously referred to travel upstream through the heat recovery steam generator and through the inlet duct to the interface with the gas turbine. Although the interaction of the pressure pulsations with the gas turbine are not fully known, it is hypothesized that the pulse is reflected off of the rotating blades of the turbine and then travels back downstream. Measurements have shown that the turbine back pressure can vary as much as 30% depending on the amplitude of the pulse. Of course, such a large variation in back pressure can have a very negative impact on the operating stability of the gas turbine. Furthermore, such pressure swings can have long term risks associated with material fatigue and stress. These same operating and structural problems will also exist to varying degrees with combustion equipment other than combined cycle systems.

SUMMARY OF THE INVENTION

The present invention relates to the elimination or reduction of the pressure pulsations caused by the gas flow patterns formed by the flue gases entering a flue gas stack from a horizontal duct or breech. More specifically, the invention involves means located in the flue gas stack to negate the interaction of the two vortices formed by the flue gases entering the stack from the breech area and allowing them to travel independently up the stack. Even more specifically, the invention involves the installation of a partition plate in the stack opposite the breech.

DESCRIPTION OF THE PREFERRED EMBODIMENT

Although the present invention can be employed in a variety of situations where the flue gases which have been generated are emptied from a horizontal duct into a circular flue gas stack, the invention is perhaps most particularly relevant to applications involving gas turbines (combined cycles and co-generation cycles) where pressure pulses and variations in back pressure can be the most harmful. Therefore, the invention will be described with specific reference to a combined cycle system recognizing that the invention is not to be limited accordingly.

Figure 1:
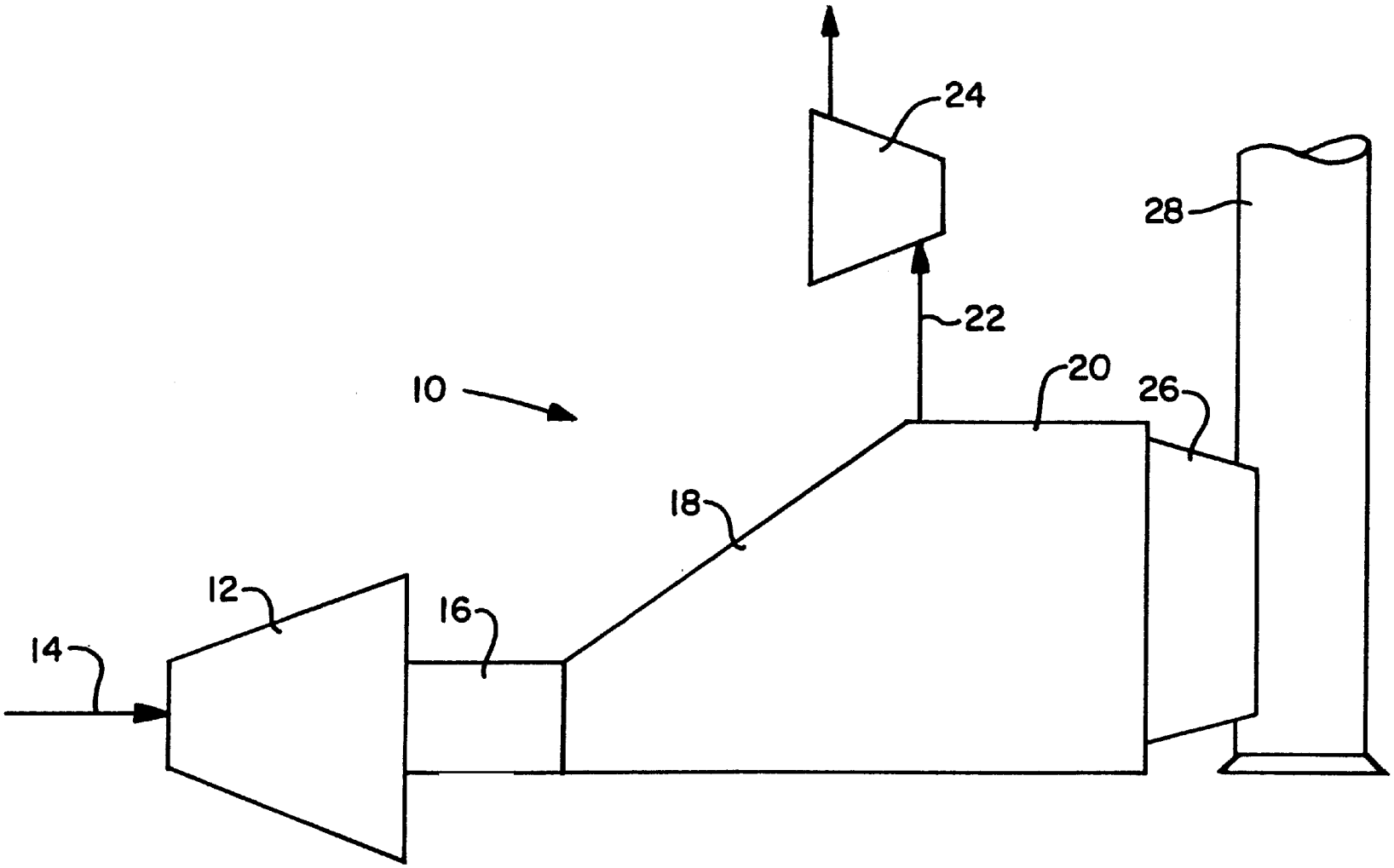
FIG. 1 generally shows a side view of a basic combined cycle system including the connection of the heat recovery steam generator to the flue gas stack.

FIG. 1 illustrates a combined cycle system generally designated 10 including a gas turbine 12, which would be connected in with a compressor and an electric generator in a conventional manner, fed with fuel and air at 14. The hot flue gas produced in the gas turbine 12 is exhausted through duct 16 into the expanding inlet transition duct 18 of the heat recovery steam generator 20. The heat recovery steam generator 20 contains the conventional heat transfer surface for steam generation and may also contain features such as catalytic nitrogen oxide reduction equipment. The steam from the heat is fed at 22 to the steam turbine 24.

As also shown in FIG. 1, the flue gas, which is now partially cooled, exits the heat recovery steam generator 20 through the duct 26 which is often referred to in the art as the breech. The duct 26, which is normally either a square or a rectangular duct as illustrated, is connected into the stack 28 at the lower end thereof.

Figure 2:
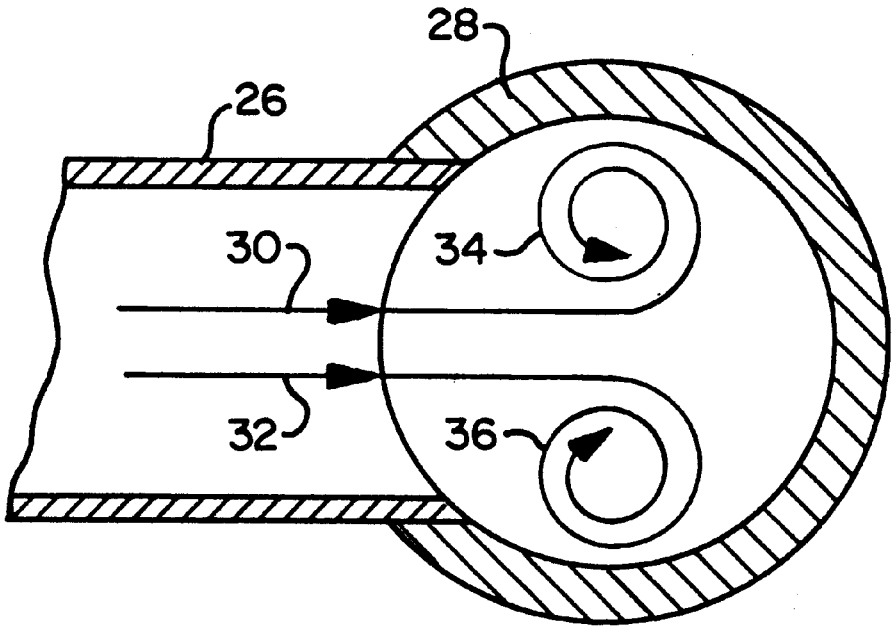
Fig. 2 PRIOR ART
FIG. 2 is a horizontal cross-section view of the connection of the breech to the flue gas stack illustrating the flue gas flow pattern.

FIG. 2 of the drawings is a horizontal cross-sectional view illustrating the interconnection between the duct 26 and the stack 28 and further illustrating the flue gas flow pattern. As shown, the flue gas is represented by the flow lines 30 and 32. As the gas flow enters the stack 28 from the duct 26, the gas flow basically divides generally down the middle and forms into the two spiral gas flow vortices 34 and 36. It is the interaction of these two vortices 34 and 36 which cause the instability resulting in pressure pulsations.

Figure 3:
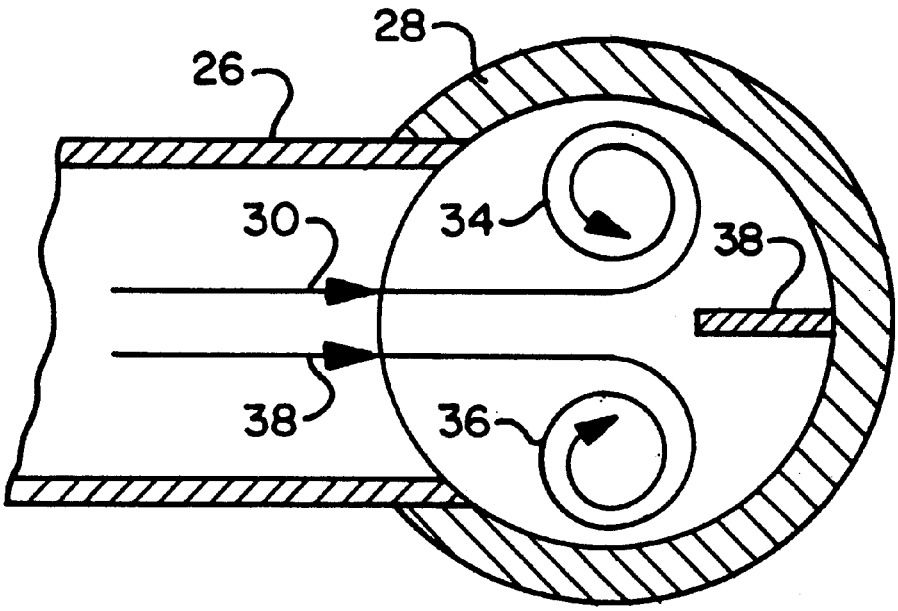
FIG. 3 is a cross-section view similar to FIG. 2 but including the partition plate of the present invention.
Figure 4:
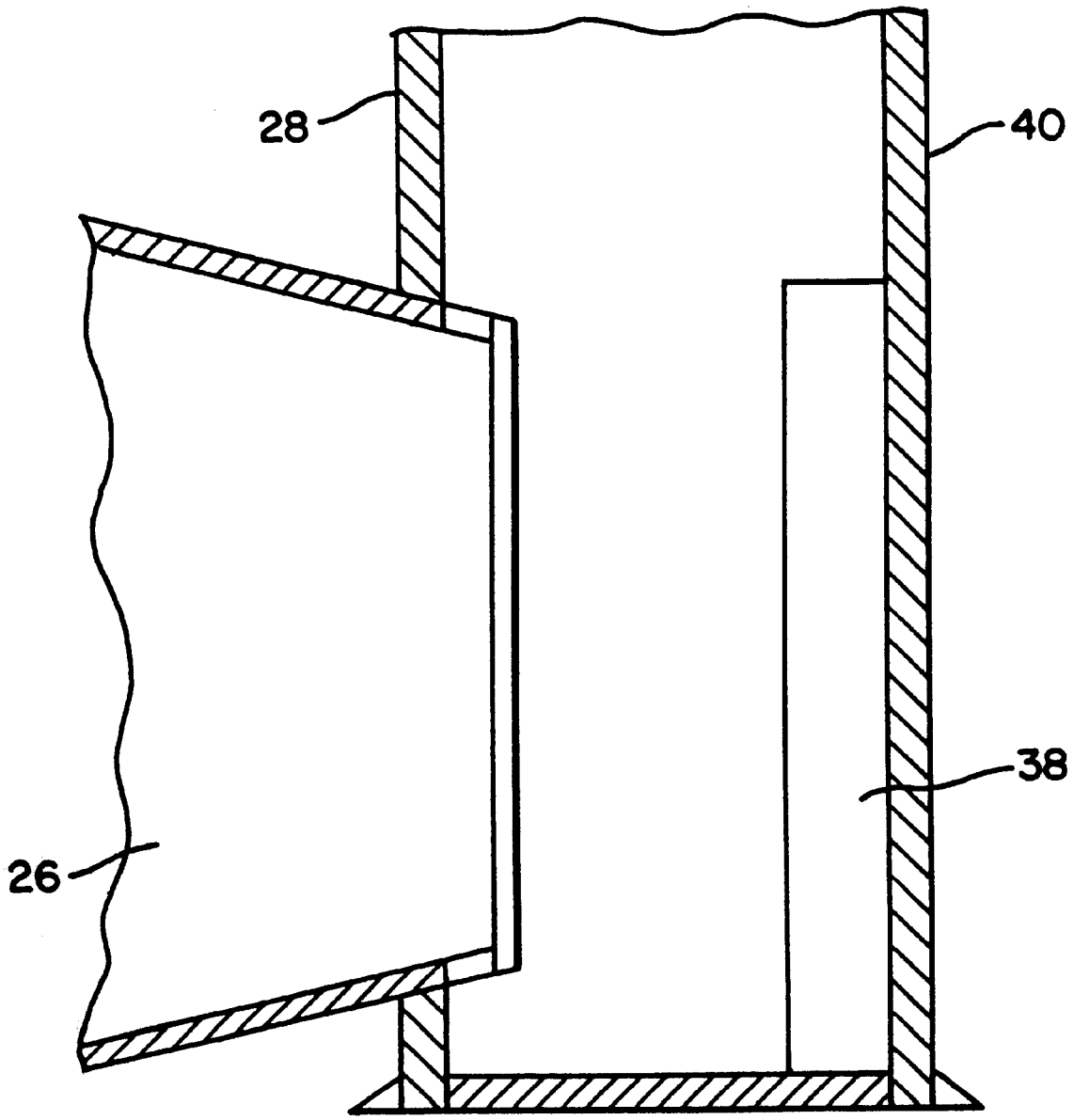
FIG. 4 is a vertical cross-section view illustrating the vertical aspects of the partition plate.

As shown in FIGS. 3 and 4, the present invention involves the installation of a partition plate 38 in the stack 28 along the wall of the stack opposite to the duct 26, herein defined as the rear wall 40 of the stack, along the vertical plane corresponding to the vertical centerline of the duct 26 and extending along a radius of the circular stack. In any specific installation, the partition may need to be offset from that location to accommodate particular gas flow patterns. Preferably, the height of the partition plate 38 extends from the bottom or near the bottom of the stack 28 up to at least the same height as the top of the duct 26. Although the optimum size (primarily height and depth) of the partition 38 will vary somewhat with each particular installation, the depth will usually be in the range of about 25 to 50% of the diameter of the stack.

We claim:

1. Means for controlling the flow of a flue gas discharged from a horizontal duct into a vertical circular flue gas stack wherein said horizontal duct is connected to an opening in one side of said vertical circular flue gas stack and wherein said means comprises a vertically extending partition plate attached to the inside of said vertical circular flue gas stack on the side opposite to said one side and opposite to said opening and extending partially across said vertical circular flue gas stack towards said opening and said horizontal duct.

2. Means as recited in claim 1 wherein said partition plate extends toward said horizontal duct along a radius of said circular stack.

3. Means as recited in claim 1 wherein said horizontal duct is rectangular or square in cross section.

4. Means as recited in claim 1 wherein said partition plate extends vertically in said stack to a level at least up to the level of the top of said horizontal duct.

5. Means as recited in claim 1 wherein said partition plate extends partially across said vertical circular flue gas stack along a radius thereof.

6. Means as recited in claim 5 wherein said partition plate extends from 25% to 50% across said vertical circular flue gas stack.

* * * * *